US008459465B2

(12) United States Patent
Cooke

(10) Patent No.: US 8,459,465 B2
(45) Date of Patent: Jun. 11, 2013

(54) ADJUSTABLE SPIRAL CONCENTRATOR

(75) Inventor: Graeme Cooke, Queensland (AU)

(73) Assignee: CPG Resources-Mineral Technologies Pty Ltd, South Brisbane, Queensland (AU)

( * ) Notice: Subject to any disclaimer, the term of this patent is extended or adjusted under 35 U.S.C. 154(b) by 19 days.

(21) Appl. No.: 13/056,409

(22) PCT Filed: Jul. 30, 2009

(86) PCT No.: PCT/AU2009/000975

§ 371 (c)(1),
(2), (4) Date: Mar. 7, 2011

(87) PCT Pub. No.: WO2010/012038

PCT Pub. Date: Feb. 4, 2010

(65) Prior Publication Data

US 2011/0186487 A1 Aug. 4, 2011

(30) Foreign Application Priority Data

Aug. 1, 2008 (AU) ..... 2008903970

(51) Int. Cl.
*B03B 5/00* (2006.01)

(52) U.S. Cl.
USPC ..... 209/459; 209/362; 209/656; 209/657; 209/697

(58) Field of Classification Search
USPC ..... 209/458, 459, 656, 657
See application file for complete search history.

(56) References Cited

U.S. PATENT DOCUMENTS

| | | | | |
|---|---|---|---|---|
| 4,597,861 | A * | 7/1986 | Wright | 209/459 |
| 4,747,943 | A | 5/1988 | Giffard | |
| 4,819,720 | A * | 4/1989 | Howard | 165/104.34 |
| 5,452,805 | A * | 9/1995 | Robertson et al. | 209/697 |
| 6,264,041 | B1 * | 7/2001 | Niitti | 209/459 |
| 6,336,559 | B1 * | 1/2002 | Knoll et al. | 209/459 |
| 7,686,170 | B2 * | 3/2010 | Palmer | 209/362 |

FOREIGN PATENT DOCUMENTS

| | | | |
|---|---|---|---|
| EP | 149518 | B1 | 7/1988 |
| EP | 2 123 361 | | 11/2009 |
| GB | 586777 | A | 3/1947 |
| SU | 1260024 | | 10/1982 |
| WO | WO 2005107963 | A2 * | 11/2005 |

OTHER PUBLICATIONS

A. B. Holland-Batt; "Some Design Considerations for Spiral Separators"; Minerals Engineering, vol. 8, No. 11, Jun. 1995, pp. 1381-1395.

* cited by examiner

*Primary Examiner* — Terrell Matthews
(74) *Attorney, Agent, or Firm* — Whitham, Curtis, Christofferson & Cook, P.C.

(57) ABSTRACT

A spiral concentrator has a spiral trough (2.001) has a concentrate gutter (2.010) and a pocket (2.008) located near the outer edge of the gutter. An inflatable bladder (2.012) is located in the pocket and can be deformed from a first state in which the bladder does not interfere with the flow of the slurry, to a second state, in which the bladder diverts the concentrate towards a concentrate gutter (2.101). Alternatively, a spiral trough has a deformable device that sits above and separate from the trough and acts as a flow diverter. As the device changes form, shape or state, it gradually contacts the trough or flow diverting more or less concentrate in a controlled manner.

14 Claims, 6 Drawing Sheets

ADJUSTABLE SPIRAL CONCENTRATOR

FIELD OF THE INVENTION

This invention relates to a spiral concentrator.

BACKGROUND OF THE INVENTION

Spiral concentrators are used to separate minerals by providing a descending spiral trough down which a mineral slurry flows. The slurry flow is subjected to centrifugal and gravitational forces. The heavier minerals (high density particles) accumulate towards the inner part of the trough and the gangue (low density particles) tend towards the outer part of the trough.

Various modifications to the trough have been proposed to improve yield. An example of a spiral concentrator with a flow diverter can be found in WO02092232.

SUMMARY OF THE INVENTION

According to an embodiment of the invention, there is provided a spiral concentrator having a spiral trough having an inner rim and an outer rim, including an adjustable flow diverter proximate the flow path, the flow diverter being adapted to adjustably divert at least part of the flow of a slurry in the trough.

The flow diverter can be controllable.

The adjustable flow diverter can be provided in the floor of the trough.

The adjustable flow diverter can be provided above the floor of the trough.

The adjustable flow diverter can be located proximate the inner rim of the trough.

The adjustable flow diverter can be located between the inner rim of the trough and the outer rim of the trough.

The flow diverter can include a depression in the floor of the trough.

The flow diverter can include a deformable member.

The deformable member can include a bladder.

The bladder can have at least a normal state and a deflated or evacuated state.

The bladder can have a normal state, an inflated state, and a deflated or evacuated state.

A protective layer can be applied to the surface of the bladder

The spiral concentrator can include two or more flow diverters as claimed in any one of the preceding claims.

The flow diverter can be an adjustable piston.

The invention also provides a spiral concentrator having a concentrate gutter.

The flow diverter can be adapted to divert slurry concentrate into the gutter.

The flow diverter can be a device that sits above the surface of the trough and, as it changes physical states, makes contact with the trough to divert flow and, in another state, has no contact with the trough leaving the flow to follow its normal trajectory.

The flow diverter can change form or shape gradually, in order to gradually divert more or less flow as desired.

The flow diverter or deflector can be separate from and proximate the floor of the trough, and can be adapted to contact the flow or the trough or both in a gradual and controlled manner.

Using the diverter, a tailing stream or middling stream can be diverted as desired by an operator.

Controlled deformation of the trough can impose a desired influence on the flow such as improving separation efficiency or altering slurry density or velocity.

Controlled deformation of a device, physically separated from the trough, can be used to impose a desired influence on the flow such as improving separation efficiency or altering slurry density or velocity.

The invention also provides a method of operating a spiral concentrator including the step of adjusting the shape of the flow diverter to discharge concentrate into a concentrate gutter.

BRIEF DESCRIPTION OF THE DRAWINGS

An embodiment or embodiments of the present invention will now be described, by way of example only, with reference to the accompanying drawings, in which.

Figure 1:
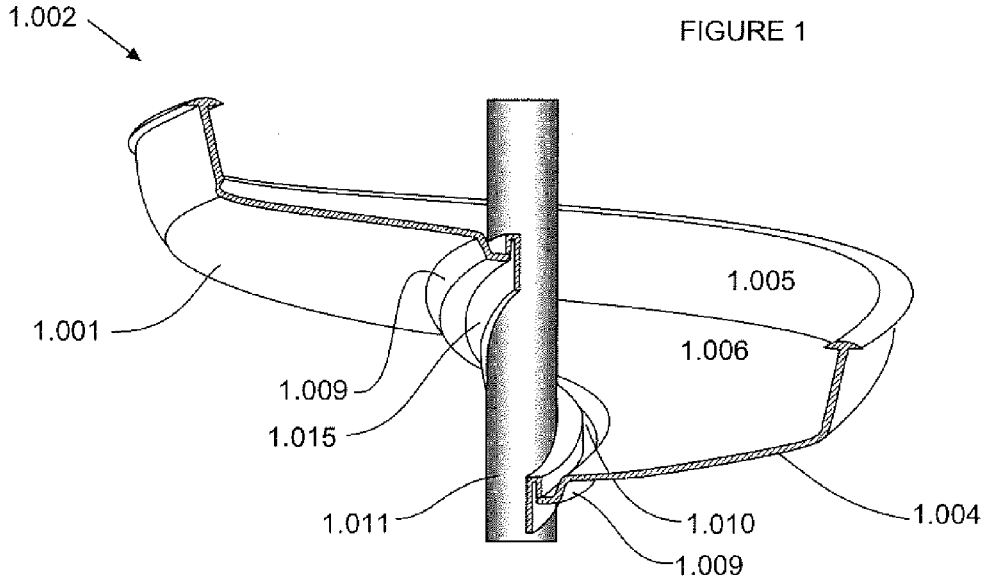
FIG. 1 is a schematic partial view of an embodiment of a spiral concentrator having a concentrate gutter.

The numbering convention used in the drawings is that the digits in front of the full stop indicate the drawing number, and the digits after the full stop are the element reference numbers. Where possible, the same element reference number is used in different drawings to indicate corresponding elements.

DETAILED DESCRIPTION OF THE EMBODIMENT

The invention will be described with reference to the embodiments illustrated in the accompanying drawings.

FIG. 1 shows a segment of a spiral concentrator having a trough 1.001 with a profile illustrated at 1.004. The trough has an outer wall 1.005 defining an outer rim and two levels, 1.006, and 1.010, with associated step 1.009 between levels 1.006 and 1.010. Level 1.010 is located towards the inner rim and forms a concentrate gutter. The spiral trough is located around a central support 1.011. The support 1.011 can be a pipe used to supply slurry to the top or inlet of the spiral concentrator, or to recycle portion of the discharged slurry to the concentrator inlet.

The spiral trough can be connected to the support pipe via a flange 1.015 and suitable fastening means such as bolts, rivets, or welds (not shown). One or more apertures (not shown) in fluid communication with the concentrate channel 1.010 can be provided in the pipe 1.011 through which the concentrate can be diverted from the duct. The pipe can include an inner pipe and an outer pipe, one of the pipes being used to supply slurry or to recycle part of the discharged slurry and the other pipe being used to collect the slurry concentrate.

In operation, the differences in density, between particles of different mineral species, cause them to separate in the slurry as they flow down the trough. The slurry at the inner portion of the trough experiences a steeper angle of descent than the slurry at the outer rim of the trough because both descend the same vertical distance per revolution, but the horizontal distance travelled at the outer rim is greater than at the inner portion of the trough. The concentrate runs off into the concentrate gutter.

Multiple spiral troughs can be wound in parallel around a common axis to increase the throughput.

In the remaining figures, the attachment flange, 1.015 in FIG. 1, has been omitted from the drawings to better illustrate other features of the invention.

Figure 2:
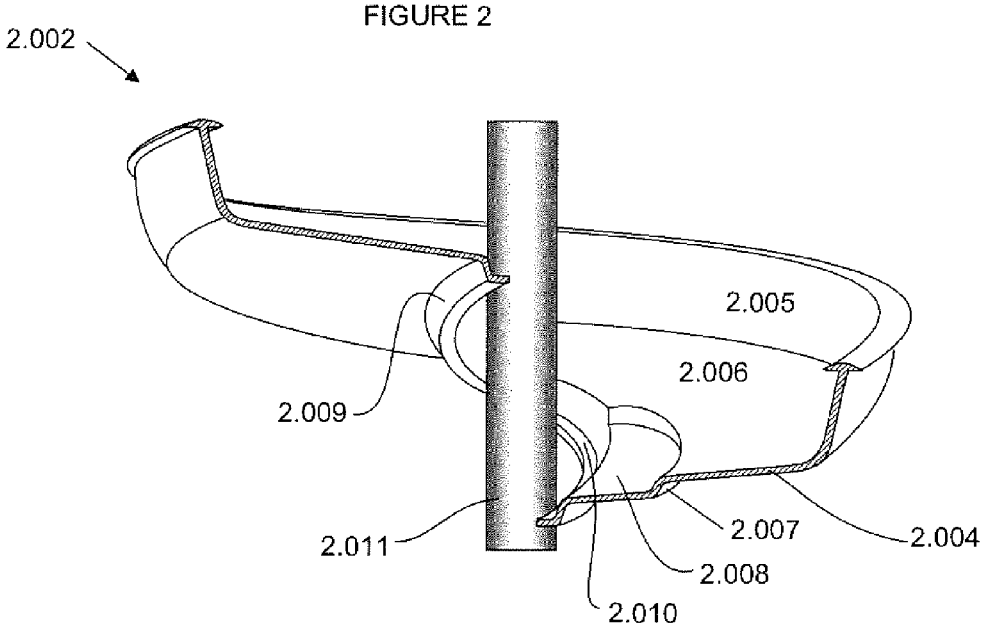
FIG. 2 is a schematic illustration of a trough according to an alternative embodiment.

The trough of FIG. 2 has been modified according to an embodiment of the invention by the inclusion of a pocket 2.008 in the floor 2006 of trough 2.004. Such a trough provides a disturbing influence on the flow of the slurry, diverting the concentrate into the concentrate gutter 2.010. In one mode of operation, the slurry may pass through the concentrator only once. In an alternative mode, at least part of the slurry drawn from the middle of the concentrator (middlings) can be re-cycled through the concentrator to improve recovery.

In a further modification, an adjustable element can be provided to alter the flow of the slurry.

While the pocket and bladder are shown as extending only a short spiral "circumferential" distance near the inner rim, the pocket and bladder can extend for a greater circumferential distance, extending up to the entire length of the trough or a shorter distance depending on the required application. In addition, one or more discrete pockets and bladders can be placed at intervals, or several contiguous bladders can be provided in a single pocket.

In a further embodiment, the adjustable member can extend across the width of the trough to provide repulping or to retard slurry flow.

Figure 3:
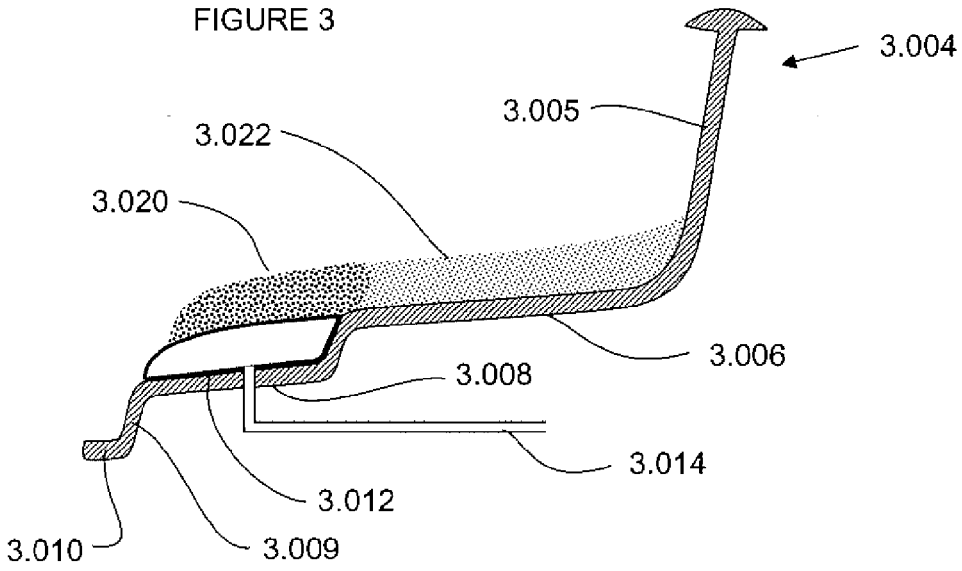
FIG. 3 is a schematic illustration of a section of a spiral concentrator duct having a flexible insert according to an embodiment of the invention.

FIG. 3 illustrates in schematic profile an arrangement according to an embodiment of the invention in which a deformable element 3.012 is located in the pocket 3.008. The deformable element 3.012 of this embodiment is in the form of a bladder which is capable of adopting two or more states. In a first state, the bladder 3.012 fills the pocket and provides a continuation of the floor 3.006 of the trough, so that it leaves the slurry flow substantially undisturbed. A pneumatic line 3.014 is provided to alter the air pressure in the bladder. The slurry is illustrated as a two part flow, the inner concentrate 3.020 and the outer "tailings" part 3.022. The pitch of the spiral trough can be selected to maintain the concentrate in the trough. The pocket 3.008 can be rigid, to support the bladder.

Figure 4:
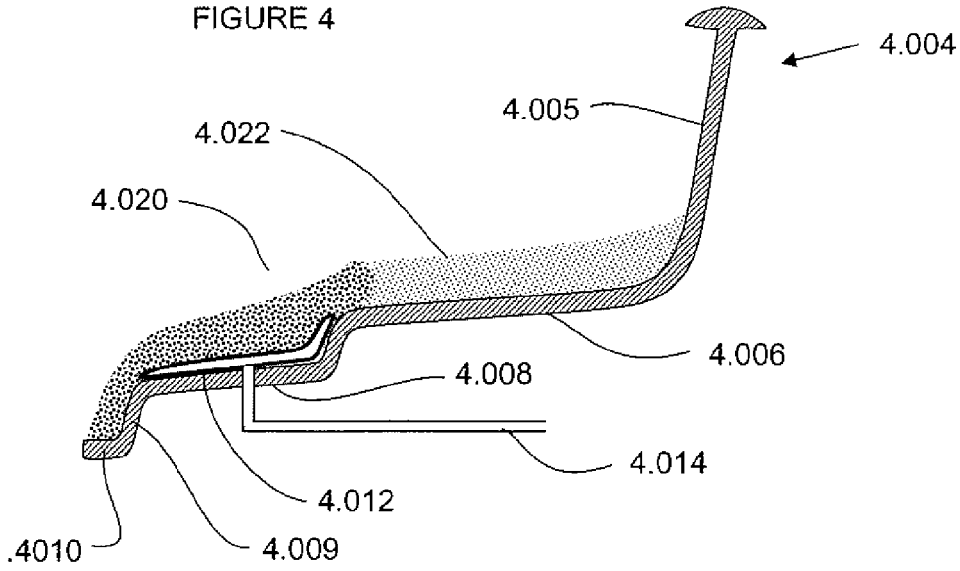
FIG. 4 is another view of the arrangement of FIG. 2 showing the deformable member in a compressed or deflated or evacuated state.

As shown in FIG. 4, when the bladder 4.012 is deflated, for example by applying a vacuum pressure via line 4.014, the bladder collapses, the flow is disturbed and the concentrate is diverted towards the centre and into the concentrate trough 4.010. As a means of adjusting the amount of concentrate diverted, the bladder could also be in a state of controlled, partial deflation.

Figure 5:
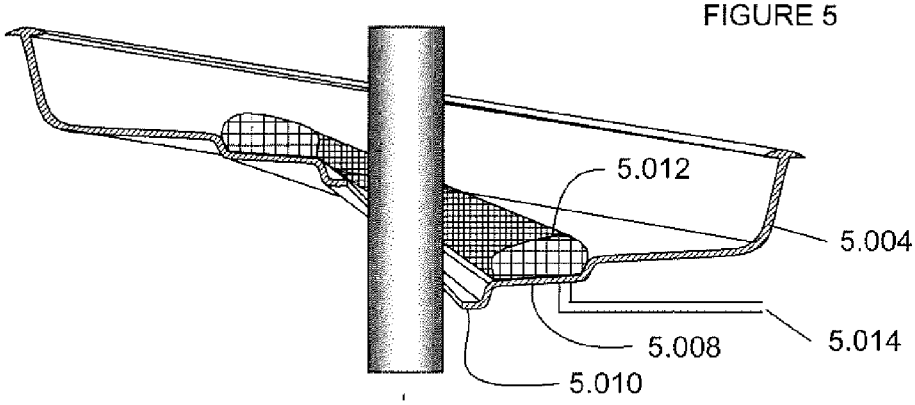
FIG. 5 is a stylised sectional view of a duct fitted with an inflatable diverter according to an embodiment of the invention.

FIG. 5 is a stylized schematic view of a portion of a spiral concentrator trough having an inflatable/deflatable element or bladder 5.012 in pocket 5.008. The bladder 5.012 is shown in an inflated state in which it projects above the floor 5.006 of the trough.

Two or more bladders can be contiguously co-located in a continuous pocket. The upper bladder can be designed to be inflated above the level of the floor of the trough by the use of compressed air or other suitable pressurized fluid. This may be used where it is desired to retain the concentrate in the trough for a specified distance. A second bladder can then be provided contiguously located in relation to the upper bladder, to divert the concentrate at a desired location. The use of several such bladders makes the equipment adaptable for differing slurries, etc.

Figure 6:
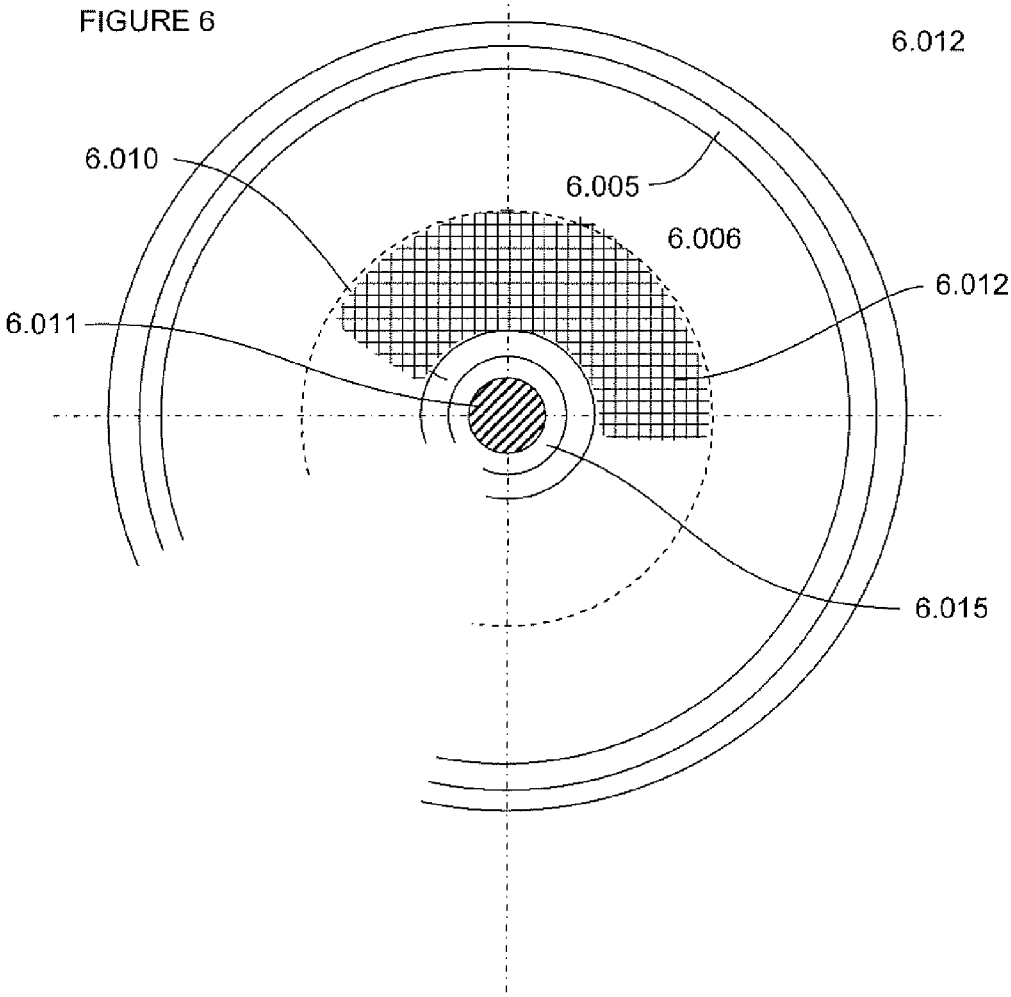
FIG. 6 is a bird's eye view of an arrangement shown in FIG. 4.

FIG. 6 is a top view of an arrangement as illustrated in FIG. 5. The outer wall 6.005 and trough floor 6.006 are shown, with the inflatable member 6.012 located at the inner part of the floor 6.006 adjacent to the concentrate trough 6.010. When the concentrate flows into the trough 6.010, it can be collected via a suitably located duct, or it can flow into the gap 6.015.

The bladder can be made of any suitable flexible air tight material which is capable of withstanding the environment of a spiral concentrator. Natural rubber, silicone rubber or polyurethane can be used for the bladder. The bladder can be provided at least on the surfaces exposed to the slurry with an exterior layer or coating to provide added strength and wear resistance. A polyethylene film or any other suitable material can be used for the exterior layer. The exterior layer can be a woven material.

A pneumatically deformable member could also constitute a bellows or telescopic type of device that expands and contracts and need not be formed from highly elastic material such as rubber. The diverter can be formed of separate parts, such as a flexible bladder having a wear-resistant surface in contact with the slurry.

Figure 7:
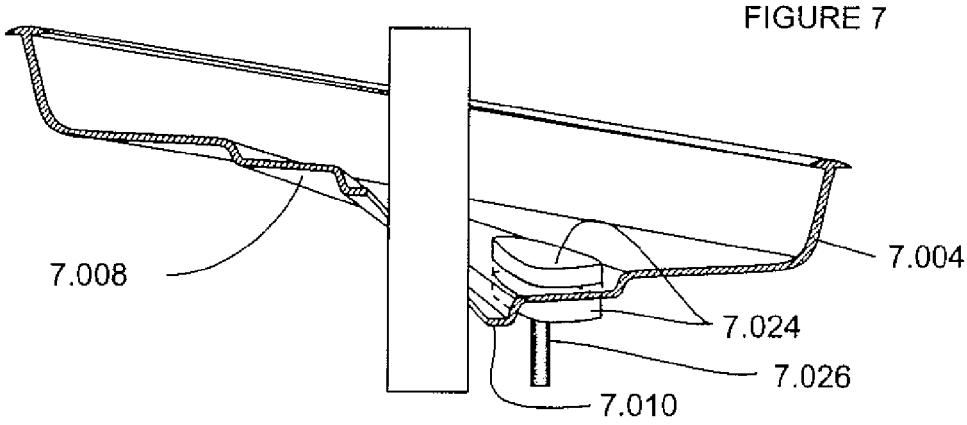
FIG. 7 illustrates a further embodiment of the invention.

FIG. 7 illustrates a further arrangement in which an adjustable piston 7.024 is located in a depression or a hole in the floor of the trough to create the flow disruption. The piston 7.024 is operated by the rod 7.026 which passes through a hole in the floor of the trough. The hole can be of a size to accommodate the piston, or, in the case where the piston is located in a depression in the floor of the trough, the hole need only accommodate the operating rod. A seal is provided around the edge of the hole.

Figure 8:
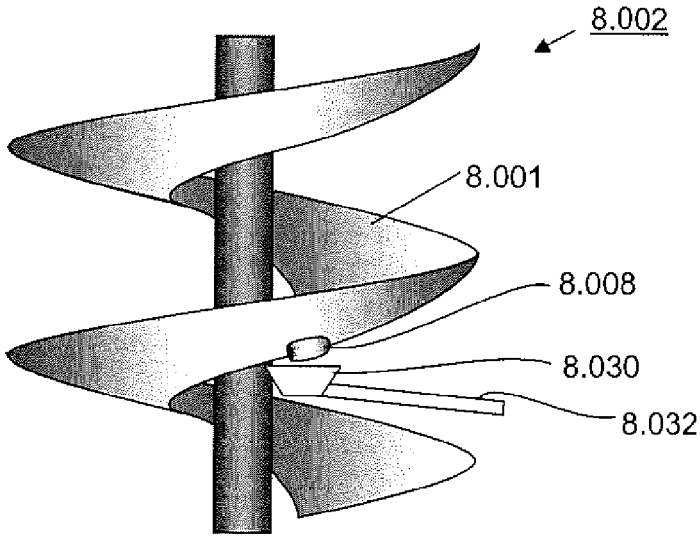
FIG. 8 is a schematic illustration of a spiral separator with a flow diverter according to an embodiment of the invention.

FIG. 8 is a schematic illustration of a spiral separator 8.001 with a flow diverter 8.002. A collection funnel 8.030 is located below the diverter pocket 8.008 and the collected concentrate is drawn off via pipe 8.032. As shown in FIG. 8, the diverter can be located at a selected location on the spiral. One or more such diverters can be located at selected locations.

Figure 9:
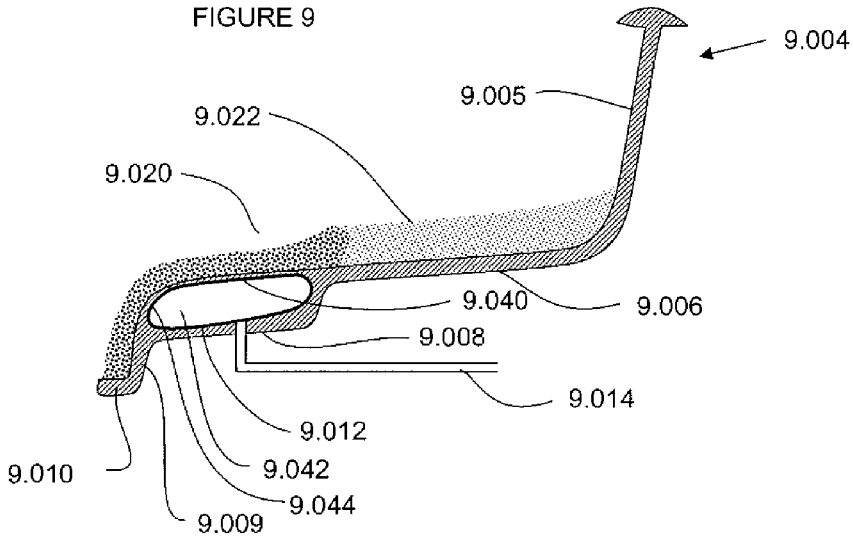
FIG. 9 illustrates an embodiment of the invention in which the deformable element is integrally formed with the spiral.

FIG. 9 illustrates an embodiment of the invention in which the deformable element is integrally formed with the spiral.

The spiral trough can be made from a resilient material or can have a top layer of resilient material, and a pocket 9.042 can be formed in the base at a desired location. The top surface 9.040 of the pocket can be sufficiently thin to deform in response to pneumatic pressure changes so it can be inflated or deflated as required. Similarly, a side wall of the pocket 9.044 can be sufficiently flexible to permit it to deform under pneumatic pressure changes.

Figure 10:
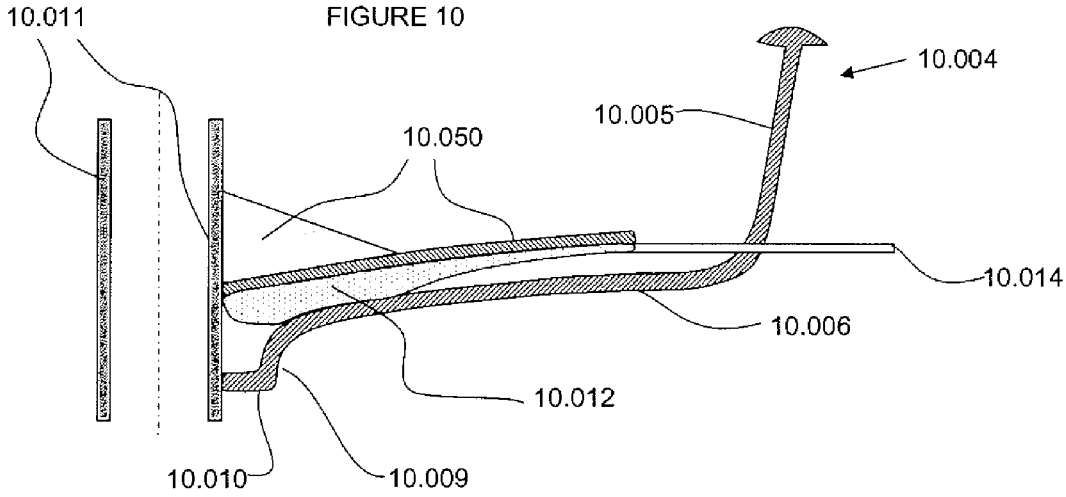
FIG. 10 illustrates an embodiment of the invention in which the deformable element is separate from, and is fixed above the trough.

FIG. 10 illustrates an embodiment of the invention in which the deformable element is separate from, and is fixed above the trough. A bladder 10.012 is attached to a rigid member 10.050. The rigid member 10.050 can be shaped and contoured to best suit gradual contact as the bladder 10.012 is inflated via line 10.014. The rigid member 10.050 attaches to the centre column (pipe) 10.011. As the area of contact between the bladder 10.012 and the trough 10.006 increases radially, the amount of concentrate diverted to the concentrate gutter increases.

Figure 11:
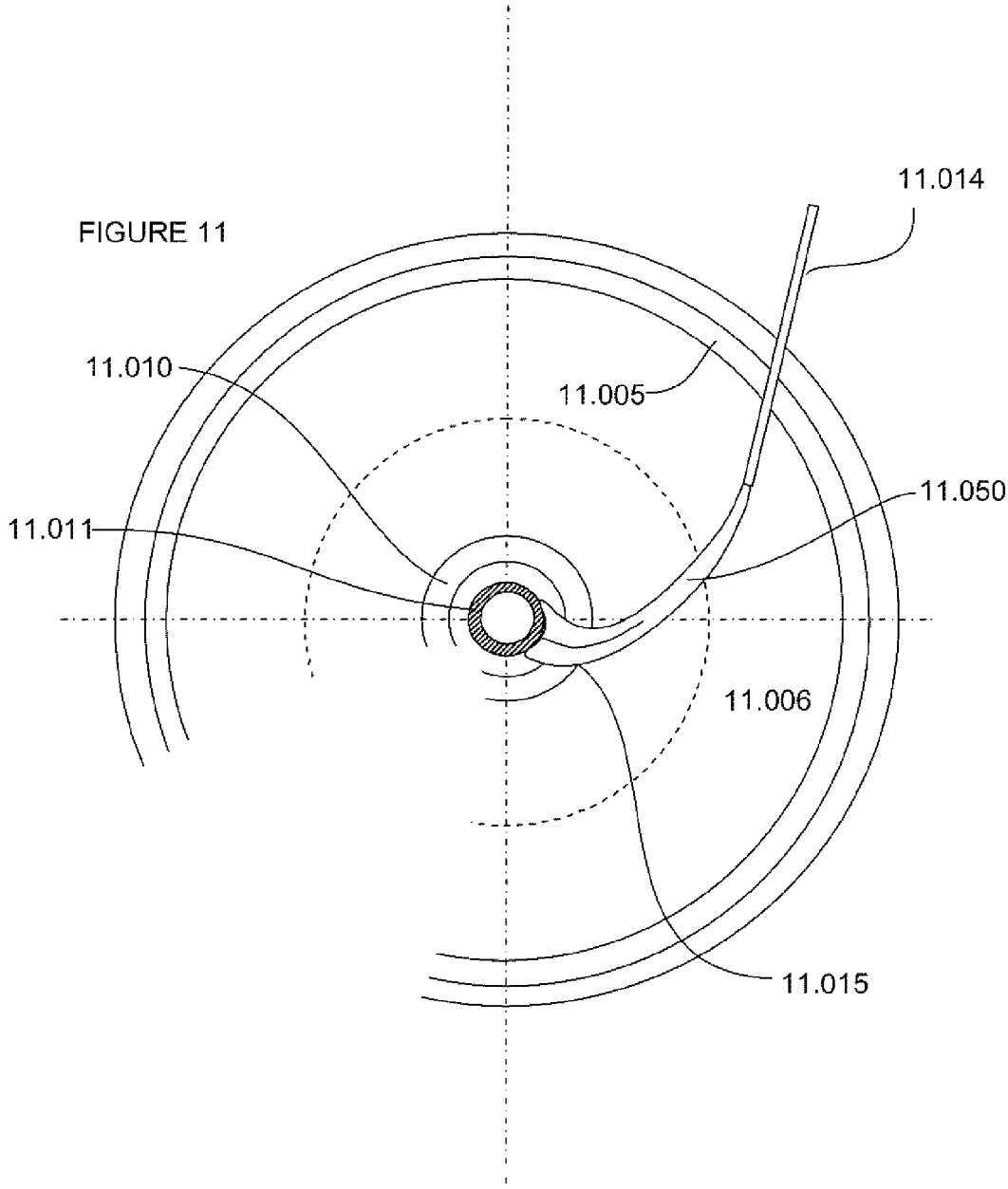
FIG. 11 shows a top view or plan view of the arrangement illustrated in FIG. 10.

FIG. 11 shows a top view or plan view of the arrangement illustrated in FIG. 10. This view shows how the deflector can be angled up-stream for more effective flow deflection.

The embodiments described above enable remote manipulation of the shape of the diverter member and hence the ability to influence the operation of the concentrator remotely. Two or more such diverters can be operated simultaneously.

In this specification, reference to a document, disclosure, or other publication or use is not an admission that the document, disclosure, publication or use forms part of the common general knowledge of the skilled worker in the field of this invention at the priority date of this specification, unless otherwise stated.

In this specification, terms indicating orientation or direction, such as "up", "down", "vertical", "horizontal", "left", "right" "upright", "transverse" etc. are not intended to be absolute terms unless the context requires or indicates otherwise.

Where ever it is used, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

It will be understood that the invention disclosed and defined herein extends to all alternative combinations of two or more of the individual features mentioned or evident from the text. All of these different combinations constitute various alternative aspects of the invention.

While particular embodiments of this invention have been described, it will be evident to those skilled in the art that the present invention may be embodied in other specific forms without departing from the essential characteristics thereof. The present embodiments and examples are therefore to be considered in all respects as illustrative and not restrictive, and all modifications which would be obvious to those skilled in the art are therefore intended to be embraced therein.

The invention claimed is:

1. A spiral concentrator having a spiral trough having an inner rim and an outer rim defining a flow path, including an adjustable flow diverter proximate the flow path, and adapted to adjustably divert at least part of the flow of a slurry in the trough, wherein the adjustable flow diverter includes a deformable member.

2. A spiral concentrator as claimed in claim 1, wherein a deformation of said deformable member is remotely controllable.

3. A spiral concentrator as claimed in claim 2, wherein the deformable member is remotely controllable by a pneumatic means.

4. A spiral concentrator as claimed in claim 2, wherein a tailing stream or middling stream is diverted as desired by an operator.

5. A spiral concentrator as claimed in claim 2, wherein controlled deformation of said deformable member imposes a desired influence on the flow such as improving separation efficiency or altering slurry density or velocity.

6. A spiral concentrator as claimed in claim 1, wherein the deformable member includes a bladder.

7. A spiral concentrator as claimed in claim 1, wherein the deformable member includes several continuous bladders in a single pocket.

8. A spiral concentrator as claimed in claim 1, wherein the deformable member includes more than one bladder placed at intervals.

9. A spiral concentrator as claimed in claim 6, wherein the bladder has at least a normal state and a deflated or evacuated state.

10. A spiral concentrator as claimed in claim 6, wherein the bladder has a normal state, an inflated state, and a deflated or evacuated state.

11. A spiral concentrator as claimed in claim 1, including a protective layer on the surface of the bladder.

12. A spiral concentrator as claimed in claim 1, wherein the flow diverter is proximate the floor of the trough, and is adapted to contact the flow or the trough or both in a gradual and controlled manner.

13. A spiral concentrator as claimed in claim 9, wherein the flow diverter is located above the trough floor.

14. A spiral concentrator as claimed in claim 1, wherein said deformable member is pneumatically deformable.

* * * * *